United States Patent [19]

Jaffa

[11] Patent Number: 4,930,413

[45] Date of Patent: Jun. 5, 1990

[54] APPARATUS AND METHOD FOR THREE-DIMENSIONAL SCREEN PRINTING

[75] Inventor: David Jaffa, Franklin Lakes, N.J.

[73] Assignee: Artwave America Inc., Hawthorne, N.J.

[21] Appl. No.: 334,354

[22] Filed: Apr. 7, 1989

[51] Int. Cl.[5] ..... B41F 15/18; B41F 15/36

[52] U.S. Cl. ..... 101/126; 101/127; 101/129; 101/474; 427/265; 427/282

[58] Field of Search ..... 101/127, 126, 114, 112, 101/407.1, 474; 118/213; 427/265, 266, 282; 108/901; 38/103, 137

[56] References Cited

U.S. PATENT DOCUMENTS

| | | | |
|---|---|---|---|
| 2,066,642 | 1/1937 | Page | 101/114 |
| 3,135,198 | 6/1964 | Kingsley | 101/474 |
| 4,135,020 | 1/1979 | Maxwell | 118/213 X |
| 4,383,482 | 5/1983 | Ito | 101/127 |

FOREIGN PATENT DOCUMENTS

| | | | |
|---|---|---|---|
| 3119974 | 12/1982 | Fed. Rep. of Germany | 427/282 |
| 102797 | 6/1983 | Japan | 101/127 |

OTHER PUBLICATIONS

Balents, "A Metal Mask and Screen Assembly", *RCA Technical Notes,* No. 978, 2 pages, Sep. 17, 1974.

*Primary Examiner*—Clifford D. Crowder

*Attorney, Agent, or Firm*—Hopgood, Calimafde, Kalil, Blaustein & Judlowe

[57] ABSTRACT

Apparatus and methods for the three-dimensional screen printing of images onto pallet-supported articles allow more than one layer of ink to be printed upon an article to form a three-dimensional design. A pallet having a compressible substrate is described; the substrate compresses to receive previously printed image masses during subsequent printing steps. A screen having baffles may cooperate with the substrate. A screen comprising dimples in its article-contacting surface is provided, whereby previously printed images may be protected from screen contact during a printing operation. Multiple printing steps may be performed without intermediate drying steps.

6 Claims, 2 Drawing Sheets

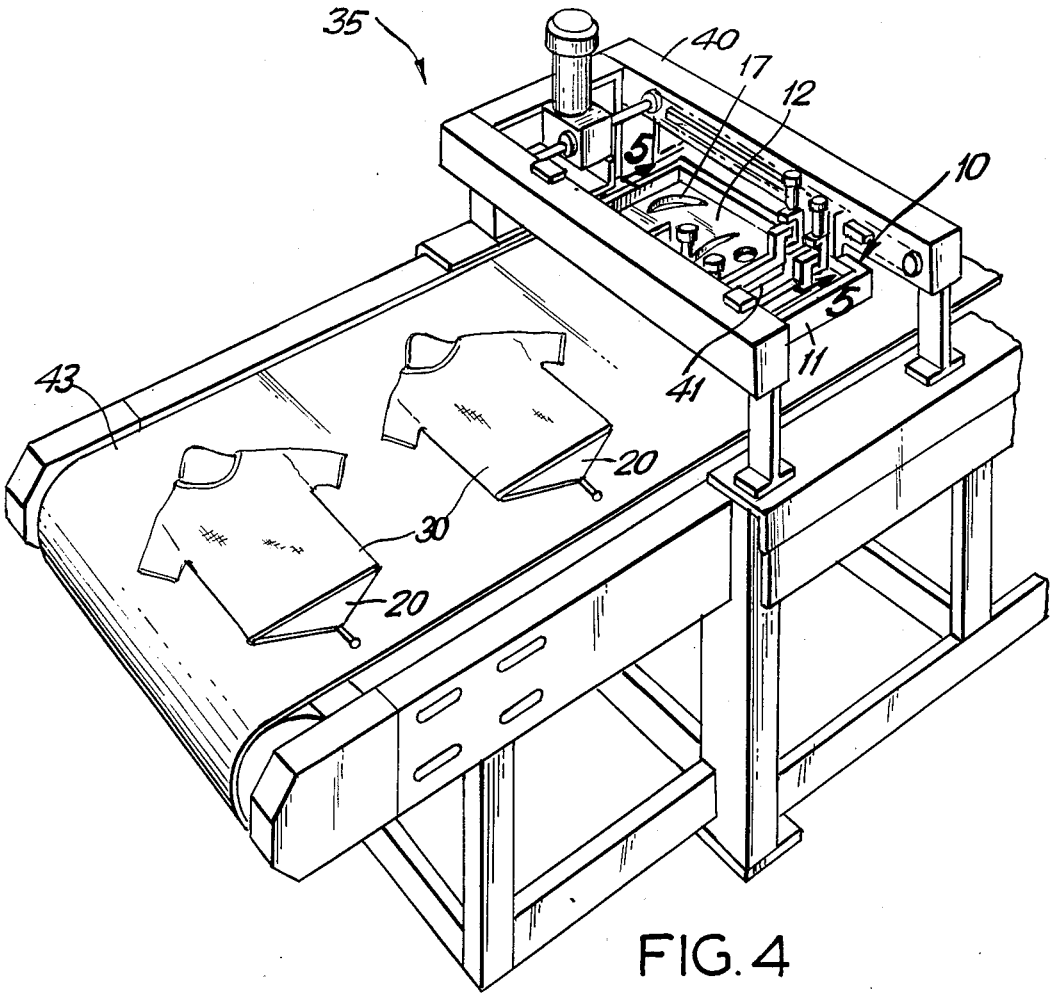
FIG. 4
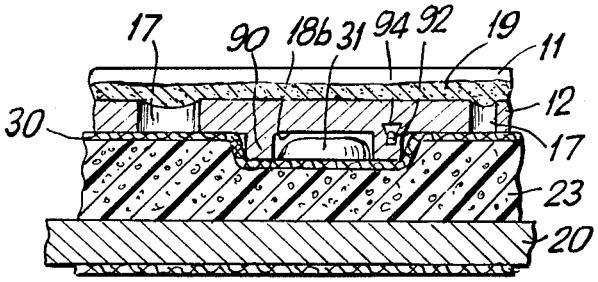
FIG. 5
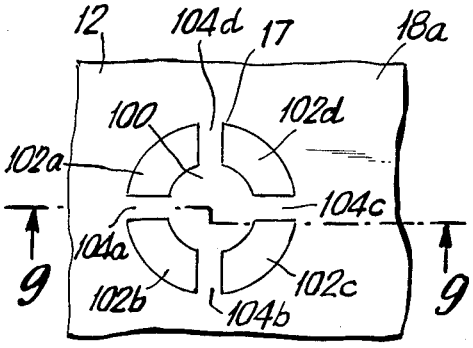
FIG. 7
FIG. 6
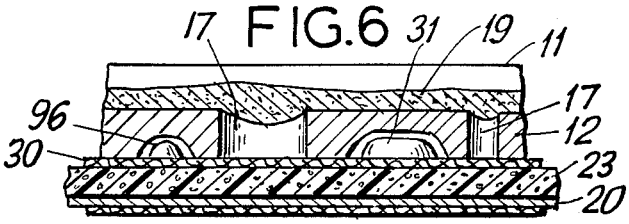
FIG. 8
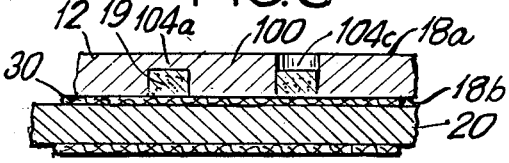

APPARATUS AND METHOD FOR THREE-DIMENSIONAL SCREEN PRINTING

BACKGROUND OF THE INVENTION

1. Field of the Invention

This invention relates to an apparatus and methods for the three-dimensional screen printing of images onto pallet-supported articles, such as clothing or other fabric material.

2. The Prior Art

The printing of images onto articles, e.g. T-shirts and the like, is commonly accomplished using screen printing machines. Generally, these machines are provided with pallet support means for transporting a series of printing pallets to and from various printing stations located along the length of the machine. The articles also may be carried on a conveyor belt. A screen printing apparatus of this general configuration is disclosed, for example, in U.S. Pat. No. 3,795,189, the disclosure of which is hereby incorporated by reference. In operation, each article to receive a print image is placed on a pallet so that the surface to be printed upon is exposed to the printing mechanism. The pallets are then indexed along a continuous path to one or more individual print stations where an image is transferred to the article positioned beneath the printing head. Alternatively, the articles may remain on a stationary print table and the screen may be carried from article to article.

It is often desirable to print more than one layer of ink, or other print media, upon a single article. To prevent smearing, the previous layer usually must be allowed to dry before the next layer is applied. When a viscous printing medium is used, such as those used in producing a three-dimensional printing effect, the thick print layer takes much longer to dry, thus slowing production. Another problem associated with three-dimensional screen printing is that a thick print image produces a very uneven surface on the article. If a further printing step is required, this unevenness prevents the next print screen from contacting the article in a smooth and continuous fashion, resulting in a poor print image. Because of this difficulty, three-dimensional images are sometimes produced by hand, resulting in a slow, labor-intensive, and consequently expensive method of production.

OBJECTS OF THE INVENTION

Accordingly, it is an object of the present invention to provide a printing screen, associated pallet, and method which facilitates the printing of three-dimensional images on an article.

Still another object of the present invention is to provide an efficient method for printing images composed of multiple layers of ink on articles which facilitates the operation of screen printing machines at high speeds.

Another object of the present invention is to provide an efficient and economical method of producing wearable art.

SUMMARY OF THE INVENTION

This invention provides for the screen printing of three-dimensional images in a relatively rapid and efficient manner.

The present invention provides a printing device for use with a pallet supported article comprising a printing screen having at least one perforation and having a thickness such that a quantity of printing medium pressed into said perforation while said screen is in contact with said article will form a three-dimensional printed image upon said article.

In another aspect of the present invention, the under surface of the printing screen is provided with a plurality of recessed or dimple means which are positioned to align with previously printed images so as to protect said images from coming into contact with said screen during a subsequent printing step. In a further embodiment, the underside of the printing screen is adapted to press against the article to be printed upon so as to deflect any mass of printing medium protruding from said article toward the pallet supporting said article.

In accordance with still a further aspect of the present invention, there is provided an apparatus for printing images on a pallet-supported article comprising a printing screen in combination with a printing pallet adapted with a resilient substrate mounted on its upper surface capable of accommodating the mass of ink deflected by the printing screen without deforming said ink.

The present invention also includes a method for three-dimensional printing of one or more layers of printing medium using the above-described printing screen and pallet assembly.

Still other objects and advantages of the present invention will become apparent from the following description of the preferred embodiments.

The present invention will now be further described by reference to the following drawings which are not intended to limit the scope of the present invention in any manner.

BRIEF DESCRIPTION OF THE DRAWINGS

FIG. 4 is a perspective view of the apparatus of FIG. 1 mounted to the head frame assembly of a screen printing machine.

FIG. 5 is a section view along line 5—5 of FIG. 4 of a second embodiment of a printing screen of the present invention which includes baffle means.

FIG. 6 is a section view of a further embodiment of a printing screen of the present invention comprising dimple means.

FIG. 7 is a top view of a printing screen of the present invention.

FIG. 8 is a section view of the printing screen taken along line 9—9 of FIG. 7.

DETAILED DESCRIPTION OF THE PREFERRED EMBODIMENTS

Figure 1:
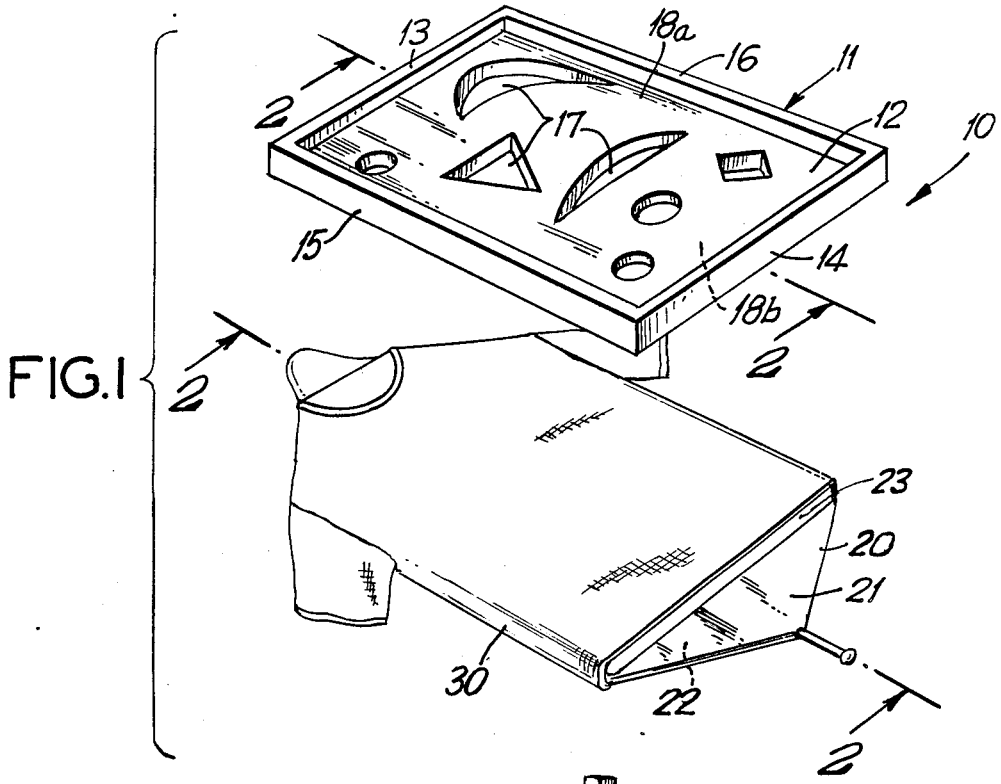
FIG. 1 is a perspective view of a screen and pallet combination for printing images on articles according to the present invention.

In the drawings, reference numeral 10 refers to the combination of screen frame assembly 11 and pallet 20.

Referring to FIG. 1, screen frame assembly 11 includes a frame having two end members 13 and 14, and two side members 15 and 16 joining the end members to form a generally rectangular structure which supports a printing screen 12. Frame assembly 11 may be assembled from side members and from end members of varying lengths and widths, to accommodate the size and shape of the particular printing screen to be used.

As can be seen from the drawing, screen 12 is provided with perforated portions 17 formed in selected shapes and sizes to create a pattern for printing an image on article 30. Perforated portions 17 permit printing material, such as highviscosity ink 19, to flow through the screen and contact article 30 when the screen frame assembly 11 and pallet 20 are in juxtaposition, as shown in FIG. 3.

Pallet 20 is of a size and shape suitable to accommodate the article 30 to be printed upon. Although FIG. 1 illustrates a pallet 20 suited to hold a T-shirt, it is understood that the pallet 20 may comprise any configuration which facilitates printing upon the selected article.

Figure 2:
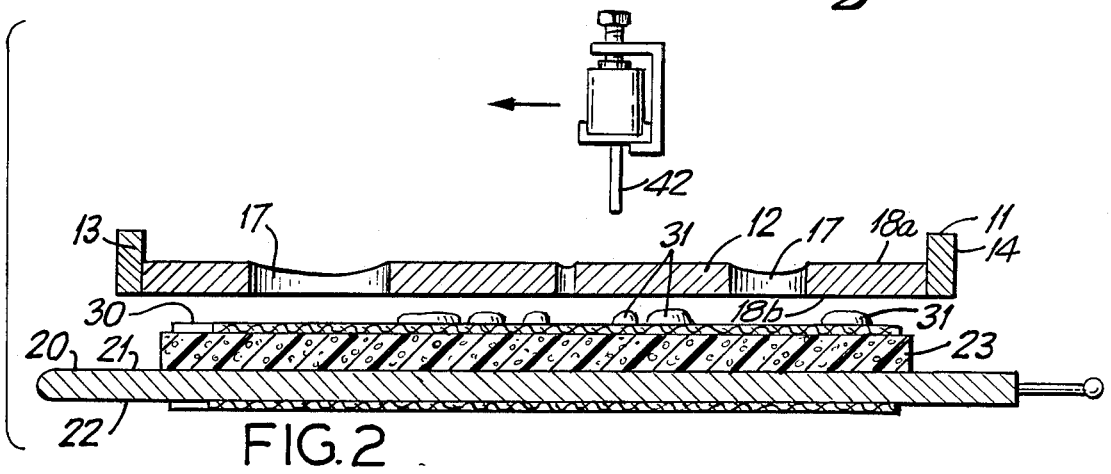
FIG. 2 is a sectional view of the embodiment of FIG. 1 taken along line 2—2 of FIG. 1 depicting the screen in the raised position.
Figure 3:
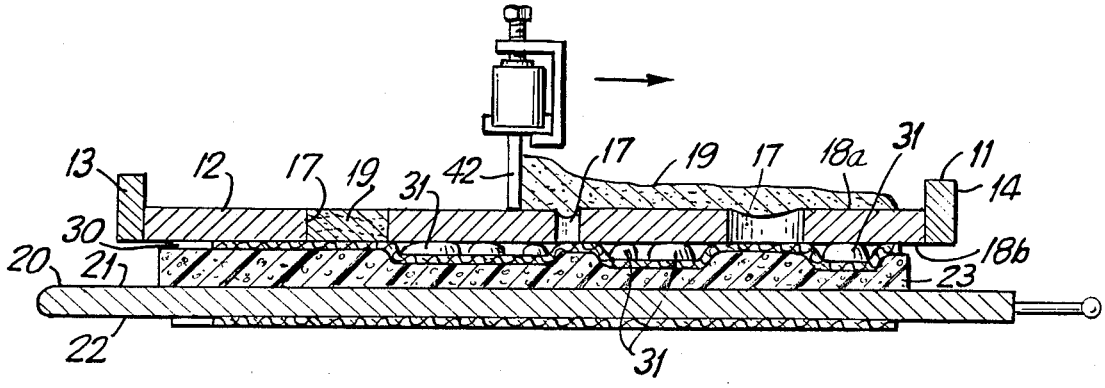
FIG. 3 is a view similar to FIG. 2 with the exception that the printing screen is shown in its lowered print position with a squeegee in the operative position.

Referring to FIGS. 2 and 3, screen 12 has a selected thickness which enables perforations 17 to mold ink 19 into ink protrusions 31 which project a predetermined distance above the surface of article 30. The screen generally has a thickness of about $\frac{1}{8}$ to $\frac{3}{8}$ inch, preferably from 3/16 to $\frac{1}{4}$ inch.

Connecting perforations 17, screen 12 is provided with nonperforated upper surface 18*a* and non-perforated lower surface 18*b*. Surfaces 18*a* and 18*b* are generally planar and parallel to each other to allow even contact with the pallet-supported article 30. The lower surface 18*b* serves to deflect protrusions 31 previously printed on article 30 toward the printing pallet.

As can be seen in the drawings, pallet 20 has an upper surface 21 and a lower surface 22. The upper surface of pallet 20 is provided with a resilient substrate 23 composed of a material that is soft, flexible, impact absorbing, smooth, flat and planar. It is desirable that the substrate material be sufficiently pliable so as to prevent deformation of protrusions 31 that it may contact. Examples of suitable substrate materials include, but is not limited to such materials as foam rubber, naturally occurring sponge, synthetic sponge, or soft polyurethane foam. Typically, the substrate material is up to one inch thick. When choosing a substrate, one must keep in mind that the substrate must be capable of retaining its resiliency even after repeated printing cycles and sustained contact with the various agents and inks used in the printing process.

In operation, article 30 mounted on pallet 20, and having printed thereon a first three dimensional image, is positioned below print screen 12 as shown in FIG. 2. As would be understood by one skilled in the art, it is essential that the first image be dried using any number of drying techniques including U.V., air or any combination thereof.

FIGS. 2 and 3 depict the positioning of the screen and pallet during the second printing step wherein some, or possibly all, of the previously created print images align with the nonperforated surface 18*b*. As can be seen in the drawings, surface 18*b* of screen 12 makes contact with the top portion of print image 31, forcing said previously printed images downwardly, thereby causing substrate 23 to deform, such that the first set of image forming protrusions 31 retain their original shape and size, while another set of image forming protrusions are being created elsewhere on article 30, by ink 19 flowing into and through perforations 17.

The thickness of substrate 23 will depend on the type of material utilized. However, it has been found that the use of a foam rubber material requires a substrate having a thickness of approximately 3 to 4 times as thick as the height of the print image to be protected from deformation. In any event, the thickness and material used for substrate 23 should be such that it is capable of absorbing all of the compressive forces acting upon the print images which come into contact with the lower surface of the printing screen, without compressing or otherwise distorting the image forming protrusions. The preferred substrate thickness is about one inch.

Substrate 23 may be attached to the upper surface 21 of pallet 20 by any suitable means including preferably a contact type adhesive. The lower surface 22 of the pallet 20 is adapted with suitable mounting means for mounting the pallet onto a conveyor apparatus for indexing to various print stations. FIG. 4 illustrates the use of the screen and pallet combination in an apparatus 35 including head frame assembly 40 which includes the carriage-supported squeegee blade 42. Each head frame assembly represents a work station where at least one printing step occurs. Even though only one assembly 40 is shown, it should be understood that several may be arranged at various spaced apart locations along the longitudinal direction of apparatus 35.

Apparatus 35 is provided with an endless belt 43 for transporting a series of pallets 20, each pallet having mounted thereon article 30 to receive a print image. When article 30 positions below head frame assembly 40, conveyor belt 43 momentarily stops and a printing cycle, including a print stroke, begins. The above described apparatus allows for the efficient and precise printing of three-dimensional print images having a variety of colors and shapes. The speed of the printing operation is limited only by the drying time of the previously printed image.

FIG. 5 depicts a cross-sectional view of another embodiment of the three-dimensional printing screen 12 according to the present invention. As will be explained in greater detail below, this embodiment is utilized in those situations where it is desirable to protect a previously printed three dimensional image from physical contact with the lower surface 18*b* of screen 12. Normally this will occur when the previously printed image has not been given adequate time to dry between printing steps. In this embodiment, screen 12 is provided with baffle means 90 located on the lower surface 18*b* and which corresponds and surrounds the previously printed image. Baffle 90 may be formed on surface 18*b* when the screen 12 is initially manufactured, such as by injection molding or casting, or may be detachable, e.g. through the use of tongue 92 and mating groove 94. Hence, the baffle can be used as a permanent part of the screen 12, or it can be a detachable appendage to be added to, or to be removed from, the screen 12. Accordingly, a printing screen provided with baffle means 90 would be used for a second, or subsequent, printing step in a multiple step printing procedure where sufficient drying time has not been allowed between the various printing operations. The baffle means 90 keeps the image 31 from contacting the lower surface 18*b* of the screen, so that if the ink comprising image 31 is wet, or is so soft as to be deformable, then there will be no distortion of the incompletely hardened image 31 by contact with the surface 18*b*.

As can best be seen in FIG. 5, during the printing cycle baffle means 90 contact the article 30 and cause deformation of the resilient substrate 23, thereby protecting the previously printed three-dimensional image by deflecting said images away from the surface 18*b* of the screen. The use of the baffled screen embodiment of the print invention alleviates the need to completely dry the ink between printing steps.

FIG. 6 shows a further embodiment of the present invention wherein an image protector means is located on the lower surface 18*b* of screen 12. In this embodiment, it is unnecessary to use a pallet having a resilient substrate mounted on its upper surface. Image protector means 96 comprise hollow, concave sections or dimples which are positioned on the underside of screen 12. Dimples 96 are adapted to coincide with, and to protect, a previously printed three-dimensional ink image 31 from contact with the lower surface 18*b* of the screen 12 during a subsequent printing step in a multi-step, multi-image printing process. The concave sections need not necessarily be of the same shape or size. However, each dimple will desirably be of a slightly larger size and of a similar shape as the previously printed image around which it is to fit. Consequently, each screen is necessarily thicker than the previous screen, to be able to accommodate the previously printed image inside its dimples.

In many instances it is desirable to create a three-dimensional printed image having a perimetric configuration. In order to produce a printed perimetric configuration, the center of the image will desirably be devoid of any ink while the surrounding perimeter will contain a continuous amount of ink of the desired thickness. To accomplish this, it is necessary for the center portion of the screen to be physically connected via bridges to the body of the print screen. However, the bridges result in a print image having spaced sections where the bridges are located, resulting in an unsightly stencil-like appearance.

In accordance with another aspect of the present invention, a printing screen is capable of producing a three-dimensional perimetric image having a continuous outer section. Referring to FIGS. 7 and 8, perforated portion 17 is made up of a solid central segment 100 that extends from the upper surface 18*a* of screen 12 to the lower surface 18*b* thereof. Adjacent to and surrounding the central segment 100 are four hollow sections 102*a*, 102*b*, 102*c*, and 102*d*. It is through these hollow sections that the viscous printing medium 19 can flow as it is squeezed from the upper surface 18*a* down through the screen onto article 30 during the print stroke. Connecting the central segment 100 with the nonperforated portions of the screen 12 are bridges 104*a*, 104*b*, 104*c*, and 104*d*.

As better shown in FIG. 8, all of the bridges, such as bridges 104*a* and 104*c*, specifically illustrated, begin at the upper surface 18*a* and extend downward by about one-fourth to one-half, desirably about one-third, of the depth shown for the central segment 100. The ink 19 is able to flow downwardly initially through the hollow sections 102 onto the surface of article 30, and then can flow perimetrically beneath the connecting bridges 104 up to the height shown in FIG. 8. The height of the three-dimensional image above the surface of article 30 is equal to the difference between the total thickness of the central segment 100 and the depth of the bridge 104. The height of the image shown in FIG. 8 is readily determined, because central segment 100 extends fully from upper surface 18*a* to lower surface 18*b* of the screen 12.

While FIG. 7 shows that there are four hollow sections, this number is merely illustrative and either a lesser or greater number of bridges may be used.

The various elements described above may be constructed of any suitable material, keeping in mind that the material must be capable of having the various shaped perforations cut into it and stiff enough to deflect ink protrusions into the resilient substrate of the pallet. It has been found that such as Plexiglas or Lexan, is an excellent screen material because it is easily molded and perforated without losing its structural integrity, lightweight and corrosion resistent, and has little or no affinity to the ink, so that it releases without clinging to the screen material. It is also transparent, so that the entire operation can be observed.

It will be appreciated that the methods described herein may be automated.

Numerous modifications will readily occur to those skilled in the art, after a consideration of the foregoing specification and accompanying drawings; it is not intended that the invention be limited to the exact construction shown and described, but all suitable modifications and equivalents may be resorted to which fall within the scope of the appended claims.

What is claimed:

1. A screen printing apparatus comprising in combination:

a printing pallet comprising a support material having a lower and an upper surface, a resilient compressible substrate having a lower surface and having a planar, soft, compressible upper surface, and an attachment means for holding said lower surface of said substrate onto said upper support surface; and, a printing screen comprising an expanse of material having at least one perforation therethrough, and further comprising baffle means attached to the lower surface of said expanse of material, said baffle means sized and located to effectively protect a previously printed raised image on the said pallet-supported article by contacting said article at points proximate to said raised image so as to deflect said image into said compressible substrate during a printing operation in which said screen is pressed against said article.

2. A screen printing apparatus according to claim 1 wherein said baffle means and said expanse of material comprise a single piece of material.

3. A screen printing apparatus according to claim 1 wherein said baffle means is removably attached to the lower surface of said material by a baffle attachment means.

4. A screen printing apparatus according to claim 3 wherein said baffle attachment means comprises: a groove in the lower surface of said material; and, a tongue protruding from said baffle means adapted to engage said groove so as to keep said baffle means securely fastened to said material.

5. A method of printing a new image onto an article having thereupon a previously printed three-dimensional image, said method comprising the steps of:

mounting said article upon a printing pallet, said pallet comprising a support mAterial having a lower and an upper surface, a resilient compressible substrate having a lower surface and having a planar, soft, compressible upper surface, and an attachment means for holding said lower surface of said substrate onto said upper support surface;

positioning a printing screen above said pallet-supported article, said screen adapted to push said previously printed image into the substrate of said pallet during the printing operation;

pressing said screen down to force said previously printed image into the substrate;

pressing a printing medium into the perforations of said screen; and, lifting said screen from said article.

6. A method of printing according to claim 5 in which said screen comprises baffle means located on the lower screen surface, said baffle means sized and located on said surface to protect said previously printed image from contact with said screen, wherein said screen is positioned over said article so that said baffles surround the image, and wherein during the pressing step said baffles press on said article at points proximate to said printed image so as to deflect said printed image into the substrate.

* * * * *